United States Patent [19]

Orlens

[11] 4,050,375

[45] Sept. 27, 1977

[54] LABEL PRINTING APPARATUS

[75] Inventor: Alfreds Orlens, Old Greenwich, Conn.

[73] Assignee: Pitney-Bowes, Inc., Stamford, Conn.

[21] Appl. No.: 655,480

[22] Filed: Feb. 5, 1976

[51] Int. Cl.[2] ..... B41J 1/60; B41K 1/12

[52] U.S. Cl. ..... 101/110; 101/111; 101/288

[58] Field of Search ..... 101/69, 110, 111, 287, 101/288, 291, 292, 293, 294, 295, 297, 298, 336, 94, 95, 99, 100, 96, 97, 102, 106, 107

[56] References Cited

U.S. PATENT DOCUMENTS

| | | | |
|---|---|---|---|
| 1,090,626 | 3/1914 | Kelley | 101/110 X |
| 1,131,959 | 3/1915 | Robbins | 101/110 |
| 1,188,828 | 6/1916 | Putnam et al. | 101/110 |
| 1,341,021 | 5/1920 | Robbins | 101/110 |
| 1,663,588 | 3/1928 | Glass | 101/110 |
| 1,868,997 | 7/1932 | Speicher | 101/110 |
| 1,928,928 | 10/1933 | Compton | 101/110 X |
| 3,482,512 | 12/1969 | Jung | 101/110 |
| 3,552,309 | 1/1971 | Stantchev | 101/336 X |
| 3,682,282 | 8/1972 | Carboni | 101/111 X |
| 3,796,152 | 3/1974 | Finke et al. | 101/111 |
| 3,926,110 | 12/1975 | Hubbard | 197/1 R X |

*Primary Examiner*—Russell R. Kinsey
*Assistant Examiner*—Paul J. Hirsch
*Attorney, Agent, or Firm*—Robert S. Salzman; William D. Soltow, Jr.; Albert W. Scribner

[57] ABSTRACT

A label printing apparatus includes a main frame, a drum housing privotably mounted in the main frame, and a printing drum, mounted in the drum housing, which comprises a plurality of discs each having a series of die groupings about its periphery as well as a groove associated with each die grouping. An assembly for setting each disc to place a selected die grouping in printing position and for simultaneously shifting all of the discs to shift each set die grouping from a first to a second character printing position comprises a spur gear mounted for reciprocation in the direction of the printing drum axis and for rotation to selectively engage each disc and to disengage from all discs. A locking bar, having a notch, is linked to the spur gear to reciprocate with it and position the notch in alignment with the disc engaged by the spur gear. The remainder of the bar projects into a groove in each of all other discs to hold them against rotation during the setting operation. However, the bar is coupled to the drum housing to pivot with it and thus shift the discs during the printing operation. An arrangement for moving a ribbon-type printing medium in operative relation to the printing drum comprises a ribbon cartridge held in the main frame by a mounting bracket. A drive train winds the medium through the cartridge past the printing drum.

1 Claim, 9 Drawing Figures

FIG. 3
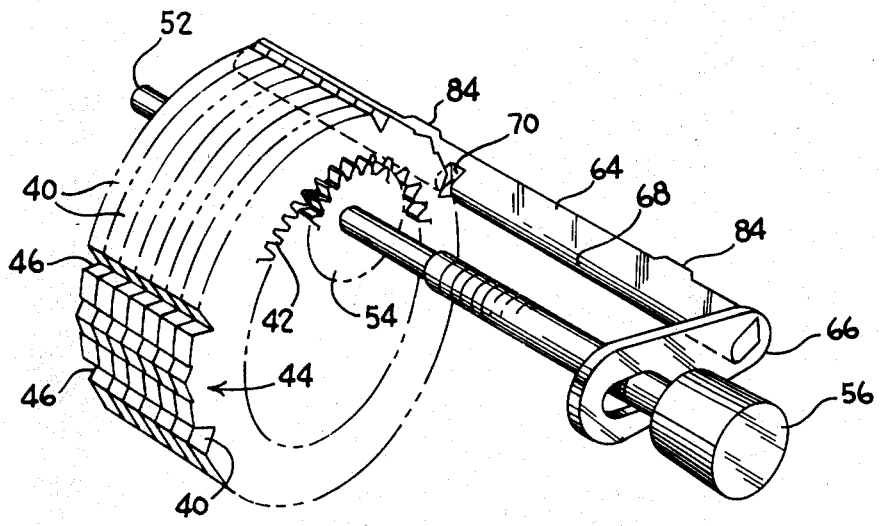
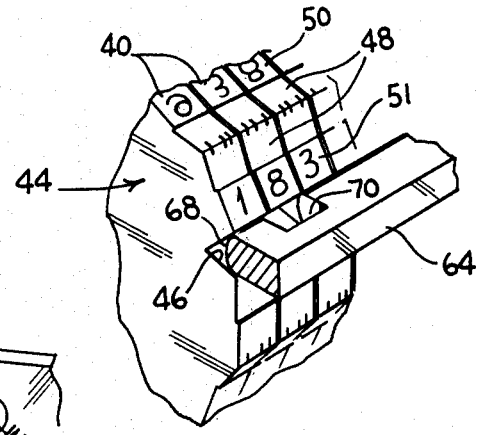
FIG. 4
FIG. 5
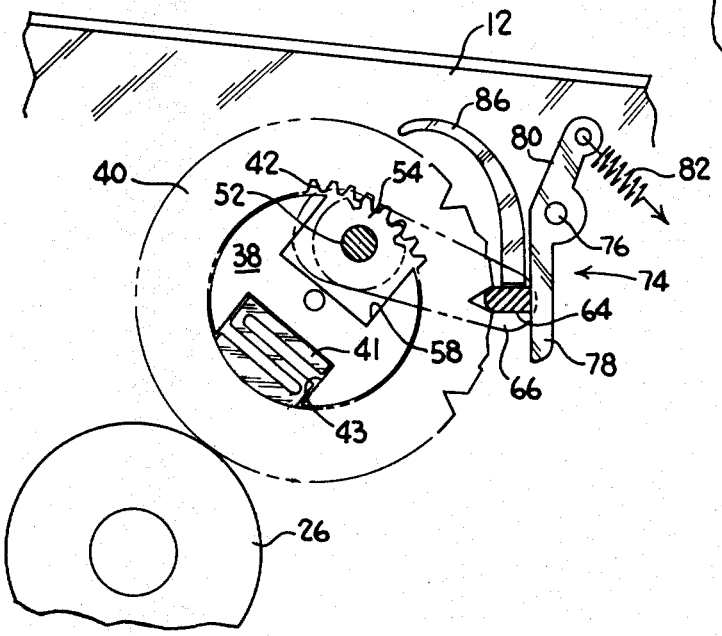

LABEL PRINTING APPARATUS

BACKGROUND OF THE INVENTION

1. Field of the Invention

The present invention relates to a label printing apparatus. More specifically, this invention relates to an assembly, in such an apparatus, for setting individual printing discs in a printing drum and for shifting the entire printing drum and further to an arrangement for moving a ribbon-type printing medium in operative relation to the printing drum.

Label printing apparatus are widely used to mark products with information useful to the consumer, such as price, as well as information useful to the seller, such as inventory control codes. Recently, it has been proposed that such information be handled by central data processing systems, known as a point-of-sale systems, in order to increase the seller's business operating efficiency and to increase the quality of service given the consumer.

Most fully integrated point-of-sale systems depend on the use of the Universal Product Code (UPC) which is comprised of ten basic characters, corresponding to the numbers 0 through 9, each having two elongated bars of preselected width and spacing. Code characters are arranged in a predetermined order on a label placed on the product which identifies the product and its manufacturer (or distributor or supplier). The point-of-sale systems scan the label, automatically tabulate the consumer's bill and process the inventory control information.

UPC labels may also include standard numeric characters printed above or below the bar code which provide the noted information. Another type of machine readable bar code is known as CODABAR (a trademark of Pitney-Bowes, Inc., the assignee of the present invention) and it may include alpha or numeric characters printed above or below its bar code. Accordingly, label printers that complement point-of-sale systems using the above codes have been devised to print both forms of the same information.

2. Description of the Prior Art

A hand-held apparatus suitable for printing UPC labels in the form described above is disclosed in U.S. Pat. No. 3,926,110 (Hubbard et al.), assigned to the assignee of the present invention. This apparatus includes a frame and a drum housing mounted for pivoted movement in the frame. A printing drum, mounted in the housing, comprises a plurality of printing discs each of which has a series of ten die groupings about its periphery. Each grouping has a bar code character printing die and a peripherally displaced, corresponding alpha-numeric character printing die. Every disc may be set to longitudinally align an array of die groupings on adjacent discs across the drum in a printing position. A printing medium, such as a non-woven ink-carrying ribbon, is drawn with a label under the bar code character dies in the aligned groupings by a rotating sprocketed platen to transfer ink to the label in a first bar code area. After the bar code has been printed, the entire drum is rotated or shifted slightly to place the alpha-numeric character printing dies in contact with the printing medium and the label. Thus, ink is transferred to the label in a second alpha-numeric area.

While the Hubbard et al. device operates smoothly and efficiently to print UPC labels, it has certain practical drawbacks. Since the bar code characters are scanned by a laser scanner, they must be precisely and uniformly printed. Accordingly, the printing discs are manufactured to small tolerances and are fit tightly together in the printing drum. Relatively high friction forces are developed between the discs. Therefore, it is difficult to set each disc to print the characters comprising the desired die grouping without disturbing adjacent discs.

Moreover, the ink-carrying ribbon in the Hubbard et al. device is conducted from one exposed spool to another. The ribbon is threaded through the device by hand in an operation which can be messy and time consuming.

Other printing devices have been proposed which include multidisc printing drums incorporating a locking arrangement for simplifying the disc setting operation. For example, U.S. Pat. No. 1,341,021 (Robbins) discloses a printing head for marking machines which comprises a spur gear engageable with any one of the printing discs, and a locking member which fits in an external groove in each disc with the exception of the one engaged by the spur gear. The locking member and spur gear may be shifted simultaneously so that all discs may individually be set.

U.S. Pat. Nos. 1,188,828 (Putnam et al.) and 1,713,528 (Glass) disclose devices similar to that described in the Robbins Patent. However, none of these three devices is designed to print on a label drawn past a printing die or to rotate or shift the entire printing head or drum to print two different character types in the same print cycle. Accordingly, none provides means for simultaneously locking of all discs. Further, force exerted by the locking member in each device is the same at all times during the disc setting and printing operations.

SUMMARY OF THE INVENTION

In a preferred embodiment, to be described below in detail, the printing apparatus of the present invention includes an assembly for setting each disc in a multidisc printing drum while locking the remaining discs, for simultaneously shifting all discs between first to second character printing positions during one printing cycle to print two forms of characters, and for locking all discs against rotation when in the first and second character printing positions during the printing cycle. This apparatus also includes an arrangement, for moving a ribbon-type printing medium in operative relation to the printing drum, which is designed to prevent unwanted unraveling of the printing medium and to permit easy handling of the medium without actually touching it. Accordingly, this printing apparatus solves several of the practical problems which characterize the Hubbard et al. device. However, the excellent label printing operation of that device is retained.

The printing apparatus of the preferred embodiment of the present invention prints a first area on a label with bar code characters and a second area on the label with second corresponding alpha-numeric characters. The apparatus comprises a main frame, and a drum housing pivotably mounted in the main frame. A gear and cam arrangement operates to pivot the drum housing at predetermined times in the printing cycle.

A printing drum is mounted in the drum housing and includes a plurality of discs each having a series of ten die groupings about its periphery. Each of the die groupings has a first bar code character printing die and a second, peripherally displaced, alpha-numeric character printing die. Further, a generally axially extending groove is associated with each die grouping.

The assembly for setting each disc, for locking all discs during portions of the printing operation, and for simultaneously shifting all of the discs between first and second character printing positions comprises a shaft mounted for axial reciprocal movement in the direction of the printing drum axis. A spur gear is mounted for rotation and reciprocation with the shaft to engage each of the discs, which are provided with meshing gear teeth, and to simultaneously disengage from all of the discs. Moreover, this spur gear has thickness less than any of the discs.

An elongated locking bar, having a notch with width greater than any disc, is linked to the shaft for reciprocal movement with it to position the notch in alignment with the disc with which the spur gear is engaged. When the spur gear is disengaged from all discs the notch is non-adjacent all discs. Accordingly, each disc may be individually set to place the desired die grouping in general printing position while all remaining discs are held in a stationary, relatively non-rotatable condition. However, when the apparatus is operated to print both bar code and alpha-numeric characters, the spur gear is disengaged from all discs and the locking bar simultaneously locks all discs against rotation.

The locking bar is also associated with the drum housing to pivot with it. During the printing operation when the drum housing is pivoted at the predetermined times by the gear and cam arrangement, all printing discs are simultaneously shifted through the locking bar to shift the set die groupings from specific bar code character to specific alpha-numeric character printing positions. That is, the drum is shifted from a condition with bar code character printing dies in specific printing position to a condition with alpha-numeric character printing dies in specific printing position.

The arrangement for moving the printing medium in operative relation to the printing drum includes a printing medium cartridge having a cartridge housing in which two spindles are mounted. The medium may be wound on either of these spindles. The cartridge is positioned in a mounting bracket associated with the apparatus frame to hold the medium in operative relation to the printing drum. A drive train is connected with one of the cartridge spindles through a coupling when the cartridge is positioned in the mounting bracket so that the printing medium may be advanced during the printing operation.

Accordingly, it is an object of the present invention to provide a printing apparatus which includes an assembly for setting each of a plurality of printing discs, for locking all of the printing discs during portions of the printing operation and for shifting the discs to print two character forms in the same printing cycle. It is a further object of this invention to provide such an apparatus with an arrangement for moving a printing medium in operative relation to the printing discs in an efficient and clean manner.

Other objects, aspects, and advantages of the present invention will be pointed out in, or will be understood from the following detailed description provided below in conjunction with the accompanying drawings.

BRIEF DESCRIPTION OF THE DRAWINGS

FIG. 3 is an enlarged perspective view of this printing drum and of portions of the assembly for setting and locking the printing discs which comprise the drum.

FIG. 4 is a perspective view enlarged even further showing the locking bar in detail.

FIG. 5 is a vertical cross-sectional view of this setting and locking assembly taken through plane 5—5 in FIG. 2.

DETAILED DESCRIPTION OF THE PREFERRED EMBODIMENT

Figure 1:
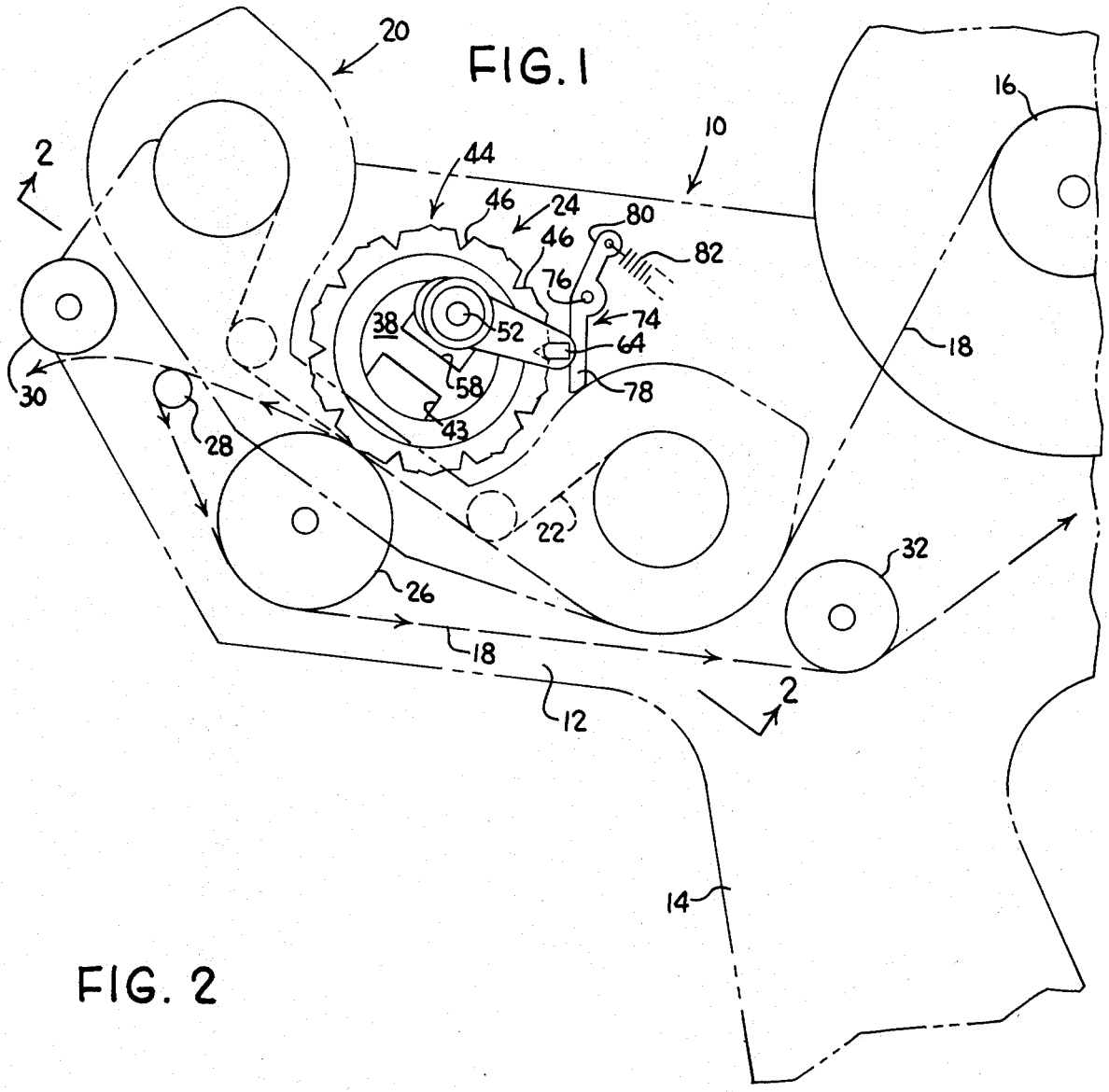
FIG. 1 is a vertical cross-sectional view of the printing apparatus of the present invention showing the interrelationship of several of its basic components.

FIG. 1 illustrates the basic components of the label printing apparatus of the present invention. This apparatus is adapted to print at least two label areas with characters and, in particular, is designed to print a first label area with bar code characters and a second label area with corresponding alpha-numeric characters. However, it may be adapted to print multiple areas on a label with any other desired character form.

The apparatus, generally indicated at 10, includes a main frame 12 which supports all of the internal apparatus components and is formed with a pistol-grip type handle 14 that may be grasped in the operator's hand. A large reel 16 is mounted for rotation at the rear of the frame 12 and stores a continuous tape 18 in the form of a support strip on which pre-cut labels having a pressure-sensitive adhesive backing are carried.

The frame 14 also supports a printing medium cartridge 20 which contains a printing medium in the form of an ink-carrying, non-woven ribbon 22. Both the cartridge 20 and the mechanism for advancing the ribbon 22 in it through the apparatus will be described in greater detail below.

The printing apparatus further includes a printing drum, generally indicated at 24, and a sprocketed platen 26 mounted to form a surface against which the printing drum may be pressed. As can be seen in FIG. 1, both the label tape 18 and the ink-carrying ribbon 22 are advanced between the printing drum and platen with the ink-carrying ribbon positioned to transfer ink to the labels carried on the backing strip. The label tape backing strip may have equally spaced holes or "T" cuts along one or both of its edges that are engaged by an advancing mechanism such as a platen sprocket for this purpose.

The label tape is guided through a preselected path, first around the smooth outer surface of the cartridge 20, over platen 26 and sharply around the small radius idler roll 28. At idler roll 28 each label is separated from the backing strip which is bent through the small roll radius. The pressure sensitive adhesive on the back of the label is thus exposed and the label may be placed directly onto the product which it is printed to identify. A pressure roller 30 is provided to insure that the label firmly contacts the product. From idler roll 28, the continuous backing strip of the label tape 18 is conducted over the bottom surface of platen 26 to a guide roll 32 and is ultimately fed out of the back of apparatus frame 12 to be discarded. The actual mechanism for rotating sprocketed platen 26 to thus advance label tape 18 is not shown. However, a suitable arrangement for doing so is disclosed in U.S. Pat. No. 3,926,110 (Hubbard et al.) and comprises a crank which is rotated by hand to drive a gear train coupled to platen 26. Alternatively, an advancing mechanism which operates through a tripper in handle 14 may be provided.

The present invention relates particularly to an assembly for setting the characters to be printed by printing drum 24 and for shifting the drum to print more than one set of characters in a single printing cycle. In order to understand the assembly, the printing drum must first be described. As illustrated in FIGS. 2 through 6, drum 24 is mounted in a drum housing, generally indicated at 34, which comprises a pair of opposed lift plates 36 between which a drum hub 38 is fixedly mounted. A pair of opposed pivot plates 39 are mounted on hub 38 for pivoted movement about the hub axis. A series of printing discs 40, which form the printing drum 24, are also mounted for rotation on hub 38. Each disc is annular in form having a ring of gear teeth 42 about its inner periphery. An S-shaped spring 41 is radially compressed in a first small channel 43, extending axially through hub 38, to hold discs 40 in radial alignment.

Ten die groupings 44 are symmetrically positioned about the outer periphery of each disc 40 and each pair of groupings 44 is separated by a generally axially extending groove 46. As can be seen in FIG. 4, each die grouping comprises a raised bar code character printing die 48 and an alpha-numeric character printing die 50 peripherally displaced therefrom. Further, each die grouping may also include an indicator panel 51 carrying a number which indicates the bar code and alphanumeric character printing die grouping in general printing position when aligned with an indicator, to be described below in detail.

Figure 2:
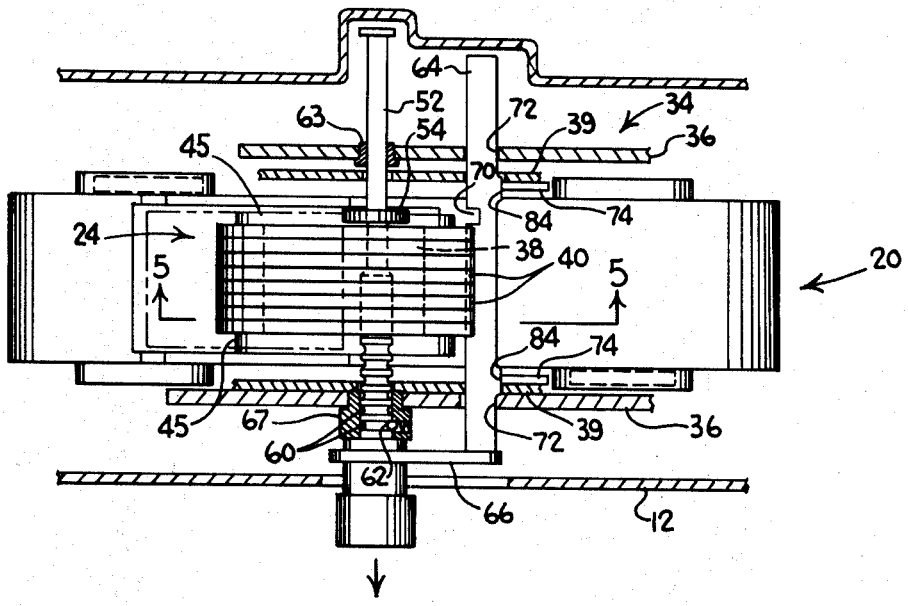
FIG. 2 is a cross-sectional view taken through plane 2—2 in FIG. 1 looking upwardly and illustrating in detail the printing drum and assembly for setting and shifting it.
Figure 6:
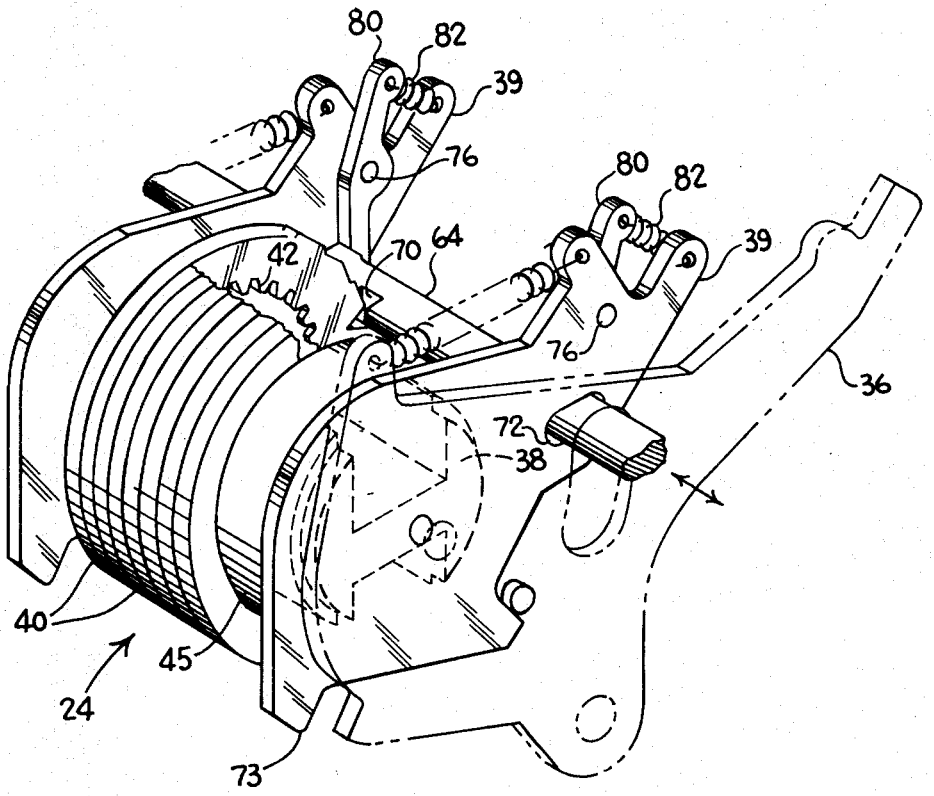
FIG. 6 is a perspective view of the drum housing and its locking bar illustrating the manner in which the printing drum is shifted between the bar code character printing position and the alpha-numeric character printing position.

Each of the discs 40 is held in a contiguous relationship by flanges 45 formed on opposite ends of hub 38 (FIG. 2). Accordingly, though each disc is separately rotatable to place the desired die grouping on it in general printing position, frictional forces are exerted between the discs. Therefore, the disc setting assembly is designed for setting one disc at a time and for locking all remaining discs in stationary, relatively non-rotatable position. As shown in detail in FIGS. 2, 3 and 5, this assembly includes a shaft 52, disposed within channel 58 (FIGS. 1 and 5) extending through hub 38, for reciprocal movement in the direction of the axes of the respective printing discs 40. Further, shaft 52 spans the distance between and extends substantially beyond lift plates 36. Bushings 63 and 67 (FIG. 2), which receive shaft 52, are mounted in each lift plate to facilitate the reciprocal movement.

A spur gear 54 is mounted on the shaft to be rotated thereby through a thumb wheel 56 and to be axially reciprocated therewith. Further, spur gear 54 is formed to engage the gear teeth 42 on the inner periphery 42 of each disc 40. Accordingly, by rotating spur gear 54 through thumb wheel 56, each disc 40 may be driven to position the desired die grouping in general printing position adjacent platen 26. In the preferred embodiment, spur gear 54 has thickness less than any disc 40 so that only one disc at a time is engaged thereby.

Referring again to FIG. 2, shaft 52 is formed with a series of annular grooves 60 which are engaged by a spring-loaded detent ball 62 carried in bushing 67. The annular grooves 60 are spaced to precisely position spur gear 54 in engagement with one disc 40 at a time so that any disc may be easily selected for setting.

The assembly for setting and locking each disc 40 further comprises a locking bar 64 which is positively coupled to shaft 52 by a link 66 to be axially reciprocated therewith and which spans the distance between and extends substantially beyond lift plates 36. As shown in detail in FIGS. 3 and 4, locking bar 64 is formed with a rounded front edge 68 adapted to project into the disc grooves 46. Further, locking bar 64 has a notch 70 formed in its front face which is slightly wider than any disc 40. As can be seen in FIG. 3, the spur gear 54, shaft 52, link 66, and locking bar 64, are assembled to position the notch 70 adjacent the outer portion of the disc with which spur gear 54 is engaged at any given time. Therefore, all discs except that engaged by the spur gear are locked so that the setting operation can be performed easily and quickly.

The setting and locking assembly may also be operated so that all discs 40 are securely locked against rotation during certain portions of the printing cycle and further may be pivoted or shifted slightly in unison about hub 38 at an appropriate time in the printing cycle. In particular, when each disc is set with a selected die grouping in general printing position, bar code character printing dies are adjacent platen 26 in specific printing position to print the selected characters in the bar code. Since platen 26 is rotated and labels as well as the printing medium are drawn past the bar code character printing dies in a first position of the printing cycle, the discs are individually locked against rotation with respect to each other. However, when bar code printing is complete, the discs are rotatively shifted as a unit to place the set alpha-numeric character printing dies adjacent the platen in specific printing position for printing in a second portion of the cycle. Again, the discs are individually locked with respect to each other. In sum, during the printing cycle the discs are always locked against rotation relative to one another. They are locked as a unit against rotation relative to the platen during the first portion of the cycle, and rotated as a unit during the second portion of the cycle.

Accordingly, as illustrated in FIG. 2, all discs are locked when the shaft is reciprocated to its extreme inward position, that is, it completely retracted into frame 12 so that spur gear 54 is disengaged from all discs 40. Moreover, at such time, notch 70 in locking bar 64 is not adjacent any disc. Therefore, all discs 40, i.e. each disc in the printing drum 24, are locked in a non-rotative position with respect to each other. Further, as shown in detail in FIG. 6, locking bar 64 is received in opposing slots 72 formed in the pivot plates 39. Those pivot plates are formed with downwardly directed cam followers 73 adapted to be engaged by a suitable cam (not shown) mounted to rotate with platen 26. Accordingly, when the cam engages the cam followers 73, pivot plates 39 are pivoted to rotatively shift the locking bar and, hence, all discs in the printing drum during the second portion of the printing cycle. The cam and cam followers are dimensioned and arranged to effect this shift so that the set bar code character printing dies are moved out of specific printing position adjacent platen 26 after the bar code has been printed and the alphanumeric character printing dies are moved into specific printing position.

The assembly described above provides a convenient means for setting individual discs to position selected die groupings in general printing position without disturbing adjacent discs. Further, the assembly is used to lock all discs in the selected printing condition and to shift the discs from a bar code character printing attitude to a alpha-numeric character printing attitude.

As shown in FIGS. 1, 2 and 5, the assembly for setting and locking each disc in the printing drum further comprises a pair of load applying levers 74 pivoted about fulcrum pins 76. Each lever has a depending portion 78, which engages locking bar 64, and a moment arm portion 80 which extends upwardly above fulcrum pin 76. A spring 82 is placed in tension between moment arm portion 80 and a suitable pin (not shown) mounted on pivot plates 39 to urge levers 74 in clockwise direction (FIGS. 1 and 5) and, in turn, to urge locking bar 64 tightly into grooves 46 in printing wheels 40. Accordingly, during the setting operation, all printing discs with the exception of that being set are positively locked against rotation. Moreover, the back of the locking bar is provided with to protruding loadbearing pads 84 which are positioned to engage the depending portion 78 of lever 74 when the locking bar is retracted completely into the frame 12 (FIG. 2). Accordingly, when the printing drum is set for a printing cycle, locking bar is urged even more tightly into grooves 46 to provide positive locking of the discs.

An indicator in the form of a pointer 86 (FIG. 5) is mounted on locking bar 64 to align with the indicating numeral 51 on the disc being set. This pointer, in cooperation with the indicating numeral, accordingly provides a convenient means by which the apparatus operator can determine both the disc with which the spur gear is engaged and, which character printing die grouping is in printing position adjacent platen 26.

Figure 7:
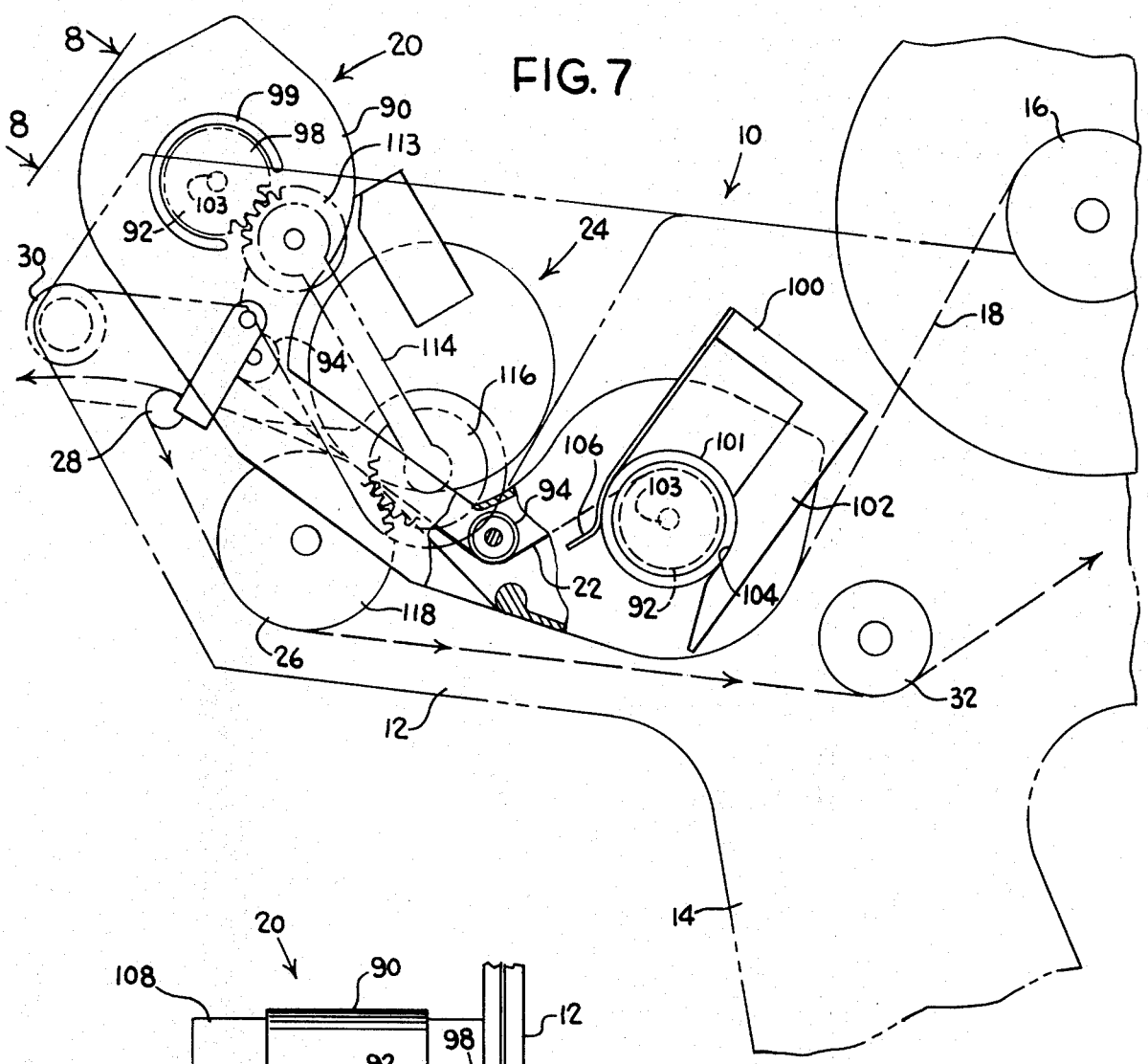
FIG. 7 is a vertical cross-sectional view, similar to FIG. 1, illustrating the arrangement for moving the printing medium in operative relation to the printing drum.

The label printing apparatus of the present invention further includes an arrangement for moving the ribbon-type printing medium in operative relation to the printing drum. This arrangement, which may be described with reference to FIGS. 7 through 9, comprises the printing medium cartridge 20 which includes a cartridge housing 90, that supports two spindles 92 for rotation on which the ink-carrying ribbon 22 may be wound. The cartridge further includes two guide rolls 94 for conducting the ribbon between the spindles in operative relation to the printing drum 24. A ribbon exposing opening 96 is formed in cartridge housing 90 between guide rolls 94 so that printing drum 24 may contact the ribbon on one side and platen may contact the ribbon on the other.

Figure 8:
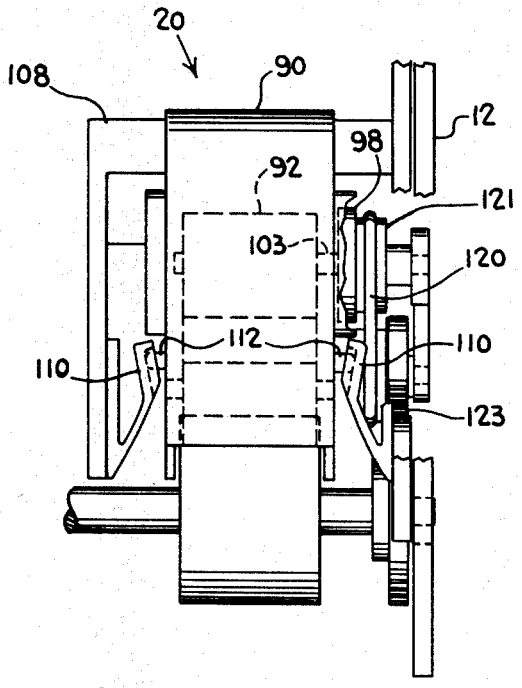
FIG. 8 is a plan view of this arrangement taken from plane 8—8 in FIG. 7.

Each spindle 92 is provided with a coupler in the form of a driven gear 98 exposed on the outer wall of housing 90, which is engaged by a mechanism, described below in detail, for advancing the ribbon through the housing in relation to the printing drum. Since the cartridge is designed to be reversed, both driven gears 98 are mounted to project from the right of their associated spindles 92 as seen in FIG. 8 when positioned in the forward upper portion of frame 12. Therefore, the gears 98 may be said to be diagonally oppositely mounted on cartridge housing 90. A C-shaped ridge 99 formed on the side of housing 90 protects the periphery of each gear 98 and a circular ridge 101, having diameter equal to that of ridge 99, is similarly formed on housing 90 about the spindle axle 103, opposite gear 98.

The ink ribbon cartridge 20 is supported in the main frame 12 by a mounting assembly comprised of a first inverted U-shaped bracket 100 which embraces the rearward lower portion of cartridge housing 90. Bracket 100 is formed with side legs 102 having partially circular openings 104 therein that embrace the C-shaped and circular ridges 99 and 101. A retaining spring 106 holds the cartridge therein. The forward upper portion of cartridge 90 is supported in a second U-shaped bracket 108 mounted with frame 12 and shown in detail in FIG. 8. Bracket 108 is provided with opposed leaf-springs 110 which engage outwardly projecting stop pins 112 formed on housing 90. Further, cartridge 20 is symmetrical about a plane perpendicular to and bisecting a plane defined by the respective axes of spindles 92. Therefore, it may be reversed in its mounting brackets 100 and 108 in frame 12 so that the ribbon 22 can be wound on either spindle 92.

The ribbon-moving arrangement also includes a drive train for rotating the spindle which is supported in upper bracket 108. This drive train includes a second driven gear 113 mounted on an arm 114 to engage the driven gear 98 supported in the upper bracket. A third driven gear 116 is supported at the opposite end of arm 114 and is in meshing engagement with a drive gear 118 mounted to rotate with platen 26. An endless belt 120 is reeved about pulleys 121 and 123 which are respectively coaxially mounted in driving engagement with gears 113 and 116. Accordingly, as platen 26 is driven by a mechanism (not shown), such as that disclosed in the Hubbard patent, driven gears 116 and 113 are rotated through endless belt 120 to in turn drive driven gear 98. Therefore, when the apparatus is actuated to print the label, both the label and ink-printing ribbons are advanced simultaneously. As noted, since the cartridge is reversible, the direction of ribbon drive is reversible. Therefore, maximum use may be derived from the ribbon by changing its direction after each cycle in cartridge 20.

Figure 9:
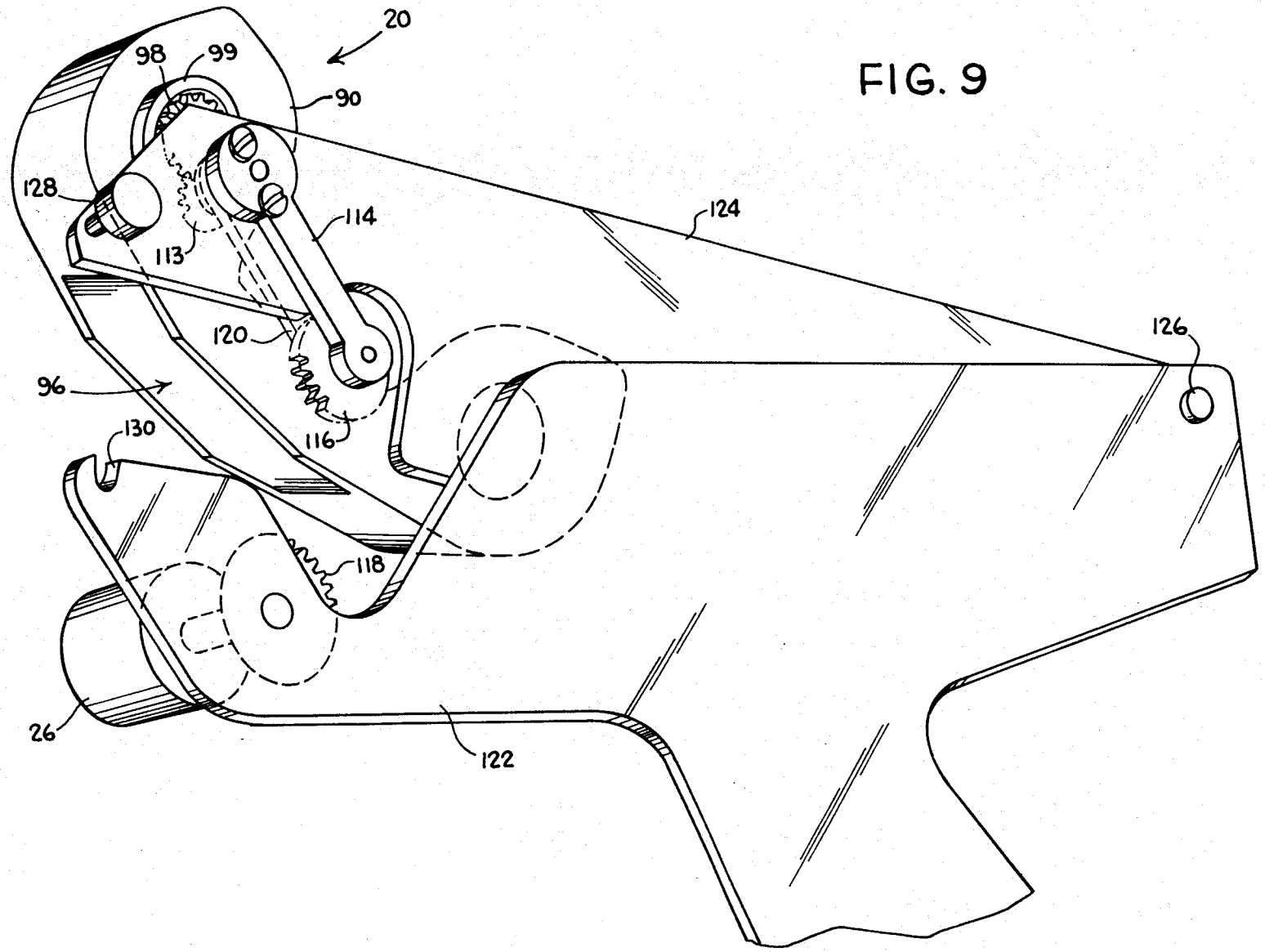
FIG. 9 is a perspective view of the printing apparatus of the present invention showing the manner in which it may be opened to replace or reverse the ribbon cartridge.

FIG. 9 shows the manner in which the ribbon cartridge 20 may be replaced. In particular, frame 12 comprises a lower portion 122 and an upper portion 124 linked together by a pivot pin 126 at the rear of frame 122. A lock screw 128 is tapped into upper frame portion 124 at its forward end and is positioned to engage a suitable notch 130 in lower frame portion 122. When the label tape is threaded in apparatus 10 or when the ribbon cartridge is replaced, the frame is merely opened by loosening screw 128 and pivoting upper frame portion 124 away from lower frame portion 122. Either operation may be then easily accomplished.

It will be appreciated that the printing medium moving arrangement incorporated in the apparatus of the present invention provides a convenient and clean means for manipulating the medium. Since the medium is contained in a cartridge housing it need not be touched by an operator. Furthermore, since the cartridge housing can be reversed to reverse the direction of advance of the medium, maximum medium life can be obtained.

Although a specific embodiment of the present invention has been described above in detail, it is to be understood that this is for purposes of illustration. Modifications may be made to the described label printing apparatus, to the assembly for setting and shifting printing discs in a printing drum and to the arrangement for moving a printing medium relative to the printing drum, by those skilled in the art in order to adapt these structures to particular applications.

What is claimed is:

1. In an apparatus for sequentially printing at least two areas with characters such as one area with first bar code characters and a second area with second corresponding alpha-numeric characters, said apparatus comprising a main frame; a drum housing pivotably mounted in the main frame, said drum housing comprising two pivot plates, mounted for simultaneous pivoted movement in the frame, each having a locking bar receiving slot therein, the printing drum being mounted between portions of the pivot plates, and said locking bar spanning the distance between the slots on the pivot plates to pivot therewith, means for pivoting the drum housing; and a printing drum, mounted in the drum housing, including a plurality of annular printing discs each having a series of die groupings about its periphery, said discs having gear teeth about their inner peripheries and a generally axially extending groove associated with each die grouping, each die grouping having at least a first character printing die and a second peripherally displaced character printing die; an assembly for individually setting each disc, for locking all discs in relatively non-rotatable position and for simultaneously shifting all of the discs to place the first and then the second character printing die in printing position; said assembly comprising:

A. setting means for selectively engaging and rotating each individual printing disc to set one die grouping thereon for printing, said setting means further being disengageable simultaneously from all of the discs, and said setting means comprising a shaft mounted for rotation and for reciprocal movement in the direction of the axis of the printing drum, and a spur gear mounted for rotation and reciprocation with the shaft to selectively engage the inner gear teeth of each disc and to disengage from the inner gear teeth of all discs, said spur gear having thickness less than the thickness of any disc, a detent means for positioning said spur gear in operative relation to the inner gear teeth of one disc at a time; and B. locking bar means linked to said setting means for projecting into the axially extending disc grooves which correspond to all set die groupings, with the exception of the groove in the individual disc with which said setting means is engaged, and for projecting into the disc grooves which correspond to all set die groupings without exception when said setting means is disengaged from all of the discs to thereby lock all discs in relatively non-rotatable position, said disc grooves being formed on the outer periphery of each disc, said locking bar means also being relatively non-rotatably coupled to the drum housing to pivot therewith, said locking bar means having an elongated locking bar, having a notch with width greater than any disc, linked to said shaft for reciprocal movement therewith to position the notch adjacent the disc with which said spur gear is engaged and to position the notch non-adjacent all discs when said spur gear is disengaged from all discs, whereby pivoted movement of the drum housing causes simultaneous pivoted movement of said locking bar means and, hence, causes the discs to shift to place the first and then the second character printing dies of the set die groupings in printing position for sequential printing thereby; and C. loading means for urging said locking bar means into the generally axially extending disc grooves, said loading means comprising, lever means mounted with said drum housing for pivoted movement about a fulcrum; spring means for urging said lever means to pivot about the fulcrum to urge said locking bar means into the disc grooves; and raised load bearing pad means formed with said locking bar means to engage said lever means when said setting means is disengaged from all discs to increase the force of urging said locking bar means into the disc grooves; and indicator means for visually indicating the individual disc with which said setting means is engaged and for indicating the die grouping set in printing position by the setting means, each die grouping including an indicating character and wherein said indicator means comprises a pointer mounted with said locking bar means to point to the disc with which said setting means is engaged and to point to the indicating character indicative of the die grouping in printing position.

* * * * *